US009688072B2

(12) United States Patent
Ohnishi

(10) Patent No.: US 9,688,072 B2
(45) Date of Patent: Jun. 27, 2017

(54) HEAD CLEANING DEVICE, INK JET RECORDING DEVICE, AND HEAD CLEANING METHOD

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/419,480

(22) PCT Filed: Aug. 6, 2013

(86) PCT No.: PCT/JP2013/071268
§ 371 (c)(1),
(2) Date: Feb. 4, 2015

(87) PCT Pub. No.: WO2014/030535
PCT Pub. Date: Feb. 27, 2014

(65) Prior Publication Data

US 2015/0217572 A1 Aug. 6, 2015

(30) Foreign Application Priority Data

Aug. 24, 2012 (JP) ..... 2012-185776

(51) Int. Cl.
*B41J 2/165* (2006.01)
*B41J 2/17* (2006.01)
*B41J 2/175* (2006.01)

(52) U.S. Cl.
CPC ..... *B41J 2/16552* (2013.01); *B41J 2/1652* (2013.01); *B41J 2/175* (2013.01);
(Continued)

(58) Field of Classification Search
USPC ..... 347/33, 28, 47
See application file for complete search history.

(56) References Cited

U.S. PATENT DOCUMENTS 4,849,769 A * 7/1989 Dressler ..... 347/27
5,412,411 A * 5/1995 Anderson ..... B41J 2/16552 347/28

(Continued)

FOREIGN PATENT DOCUMENTS

JP 2003341029 A * 12/2003
JP 2004-216642 8/2004

(Continued)

OTHER PUBLICATIONS

"International Search Report (Form PCT/ISA/210)", mailed on Sep. 3, 2013, with English translation thereof, pp. 1-2.

(Continued)

*Primary Examiner* — Matthew Luu
*Assistant Examiner* — Lily Kemathe
(74) *Attorney, Agent, or Firm* — Jianq Chyun IP Office

(57) ABSTRACT

The aim is to provide a low cost and highly reliable head cleaning technique. As a solution, a cleaning device 20 includes a cleaning tank 21 for immersing a head 10 in cleaning solution and cleaning the head; and liquid level height adjusting means for adjusting a liquid level height of the cleaning solution in the cleaning tank 21, wherein the liquid level height adjusting means includes a supply chamber 25 that stores the cleaning solution to be supplied to the cleaning tank 21, and communicates with the cleaning tank 21, and a driving section 23 for adjusting relative heights of the cleaning tank 21 and the supply chamber 25 by moving the supply chamber 25.

8 Claims, 4 Drawing Sheets

(52) U.S. Cl.
CPC ..... *B41J 2/1714* (2013.01); *B41J 2/17556* (2013.01); *B41J 2/17566* (2013.01)

(56) References Cited

U.S. PATENT DOCUMENTS

| | | | | |
|---|---|---|---|---|
| 6,796,634 | B2 * | 9/2004 | Caren et al. | 347/28 |
| 7,300,134 | B2 * | 11/2007 | Suzuki | B41J 29/393 347/28 |
| 7,753,474 | B2 * | 7/2010 | Hiruma et al. | 347/29 |
| 7,775,621 | B2 * | 8/2010 | Chun | B41J 2/16552 347/21 |
| 7,871,147 | B2 * | 1/2011 | Suzuki | B41J 29/393 347/29 |
| 8,262,195 | B2 * | 9/2012 | Maida et al. | 347/33 |
| 8,764,159 | B2 * | 7/2014 | Maida | B41J 2/16588 347/21 |
| 2007/0103512 | A1 * | 5/2007 | Miura et al. | 347/47 |
| 2007/0195122 | A1 * | 8/2007 | Hiruma et al. | 347/29 |
| 2010/0149289 | A1 * | 6/2010 | Saeki | B41J 2/175 347/85 |
| 2012/0050393 | A1 * | 3/2012 | Usui | B41J 2/16517 347/22 |

FOREIGN PATENT DOCUMENTS

| | | |
|---|---|---|
| JP | 2004-358667 | 12/2004 |
| JP | 2006-123240 | 5/2006 |
| JP | 2010-234740 | 10/2010 |
| JP | 2011-73295 | 4/2011 |

OTHER PUBLICATIONS

"1st Office Action of China Counterpart Application", issued on Sep. 11, 2015, pp. 1-17, with English translation thereof.

* cited by examiner

HEAD CLEANING DEVICE, INK JET RECORDING DEVICE, AND HEAD CLEANING METHOD

CROSS-REFERENCE TO RELATED APPLICATION

This application is a 371 application of the International PCT application serial no. PCT/JP2013/071268, filed on Aug. 6, 2013, which claims priority benefits of Japan Patent Application No. 2012-185776 filed on Aug. 24, 2012. The entirety of each of the above-mentioned patent applications is hereby incorporated by references herein and made a part of this specification.

TECHNICAL FIELD

The present invention relates to a head cleaning device, an ink jet recording device, and a head cleaning method.

BACKGROUND ART

As a technique to clean an ink jet printer head, conventionally a technique that immerses the head in cleaning solution has been known. Patent Document 1 describes an ink jet head cleaning device that includes: a discharge hole for discharging ink; a head immersing container containing cleaning solution into which an ink jet head including the discharge hole and having an opening communicated with an ink passage is immersed, the head immersing container applying ultrasound vibration to the cleaning solution; an immersing section that retains the ink jet head and immerses the ink jet head freely in and out of the cleaning solution within the head immersing container; a flowing section communicated with the opening of the ink jet head, and causes the cleaning solution to flow through the ink passage of the ink jet head, which is immersed in the ultrasonically vibrating cleaning solution by the immersing section within the head immersing container; and a drying section communicated with the opening of the ink jet head, and dries the ink passage by sending gas in the ink passage of the ink jet head that has been pulled out of the ultrasonically vibrating cleaning solution by the immersing section within the head immersing container.

PRIOR ART DOCUMENT

Patent Document

Patent Document 1: JP 2004-358667 A (published on Dec. 24, 2004)

SUMMARY OF THE INVENTION

Problems to be Solved by the Invention

However, by the cleaning technique for the ink jet printer head in the conventional technique, complicated mechanisms accompanying pumps, valves, and the like and a control device therefor become necessary for supplying the cleaning solution (see FIG. 3, etc. of Patent Document 1). Further, there also is a need to detect liquid level, liquid pressure and the like of the cleaning solution to supply an appropriate amount of cleaning solution. Due to this, cost was high with the cleaning technique for the ink jet printer head in the conventional technique, and reliability thereof was in some cases reduced.

The present invention has been made in view of the above problem, and mainly aims to provide a low cost and highly reliable head cleaning technique.

Solutions to the Problems

In order to solve the above problem, the head cleaning device according to the present invention includes a cleaning tank for immersing a recording head in cleaning solution and cleaning the recording head; and liquid level height adjusting means for adjusting a liquid level height of the cleaning solution in the cleaning tank, wherein the liquid level height adjusting means includes a supply chamber that stores the cleaning solution to be supplied to the cleaning tank, and communicates with the cleaning tank, and driving means for adjusting relative heights of the cleaning tank and the supply chamber by moving at least any one of the cleaning tank and the supply chamber.

According to the above configuration, since the cleaning tank and the supply chamber are communicated, the cleaning solution moves between the cleaning tank and the supply chamber in accordance with the relative heights of the cleaning tank and the supply chamber. Due to this, the liquid level height adjusting means can suitably adjust the liquid level height of the cleaning solution within the cleaning tank by using the driving means for adjusting the relative heights of the cleaning tank and the supply chamber.

According to this, the advantageous effect of being able to supply a suitable amount of cleaning solution into the cleaning tank even without the need to use a pump, a liquid level sensor, and the like can be achieved. Thus, a low cost and highly reliable head cleaning technique can be provided.

Further, the liquid level height adjusting means can easily discharge the cleaning solution from within the cleaning tank by making the height of the supply chamber sufficiently lower than the height of the cleaning tank by the driving means. Here, since the cleaning tank includes the opening for inputting the recording head, the cleaning solution can volatilize from this opening also during when the recording head is not being cleaned, however, according to the above configuration, the advantageous effect that the volatilization of the cleaning solution can be reduced by discharging the cleaning solution from within the cleaning tank can also be achieved.

In the head cleaning device according to the present invention, the supply chamber preferably includes a ventilation opening.

According to the above configuration, since the ventilation opening is provided in the supply chamber, air pressure within the supply chamber is always kept at atmospheric pressure, and gas can be supplied into and discharged from the supply chamber depending on changes in the cleaning solution amount in the supply chamber. According to this, the movement of the cleaning solution between the cleaning tank and the supply chamber can be made smoother.

In the head cleaning device according to the present invention, a communication opening for communicating with the supply chamber is preferably provided at a bottom portion of the cleaning tank.

In the cleaning tank, in case where the communication opening for communicating with the supply chamber is provided at a position that is higher than the bottom portion of the cleaning tank, the cleaning solution stored at a position lower than the communication opening cannot be discharged from the cleaning tank even if the relative heights of the cleaning tank and the supply chamber are adjusted.

Here, according to the above configuration, since the communication opening is provided at the bottom portion of the cleaning tank, the cleaning solution can efficiently be evacuated from the cleaning tank to the supply chamber. According to this, the volatilization of the cleaning solution from within the cleaning tank can suitably be prevented.

The head cleaning device according to the present invention preferably includes a discharging passage for discharging the cleaning solution stored in at least any of the cleaning tank and the supply chamber; and an opening and closing means for opening and closing the discharging passage.

By using the cleaning solution for plural times, there is a risk that a cleaning effect is reduced by the cleaning solution becoming dirty, however, high cleaning effect can be maintained by replacing the cleaning solution by discharging the cleaning solution through the discharging passage.

The head cleaning device according to the present invention preferably includes an airtight cleaning solution tank for storing the cleaning solution; and a communication passage for communicating the cleaning solution tank and the supply chamber, wherein the communication passage opens in the supply chamber at a position that is higher than a bottom surface of the supply chamber.

According to the above configuration, due to the opening of the communication passage in the supply chamber is at the position higher than the bottom surface, air moves to the cleaning solution tank through the communication passage when the liquid level of the cleaning solution in the supply chamber has become lower than the opening. At this occasion, the cleaning solution is supplied to the supply chamber from the airtight cleaning solution tank. According to such a mechanism, a suitable amount of cleaning solution can easily be supplied to the supply chamber.

The head cleaning device according to the present invention preferably has the cleaning tank and the supply chamber opened to atmosphere.

According to the above configuration, due to both of the cleaning tank and the supply chamber being opened to the atmosphere, the liquid level heights of the cleaning solution in the cleaning tank and the supply chamber can surely be matched. According to this, the movement of the cleaning solution between the cleaning tank and the supply chamber can be made smoother.

An ink jet recording device according to the present invention is provided with the head cleaning device according to the present invention.

According to the above configuration, an ink jet recording device having a low cost and highly reliable head cleaning device can be provided.

A head cleaning method according to the present invention includes: a cleaning step of cleaning a recording head by immersing the recording head in cleaning solution within a cleaning tank; and a liquid level height adjusting step of adjusting a liquid level height of the cleaning solution within the cleaning tank, wherein, in the liquid level height adjusting step, relative heights of the cleaning tank and a supply chamber are adjusted by moving at least any one of the cleaning tank and the supply chamber, and the supply chamber stores the cleaning solution to be supplied to the cleaning tank and communicates with the cleaning tank.

According to the above method, the advantageous effects of that, which are the same as those of the head cleaning device according to the present invention, can be achieved.

Effects of the Invention

According to the present invention, a low cost and highly reliable head cleaning technique can be provided.

EMBODIMENTS OF THE INVENTION

Figure 1:
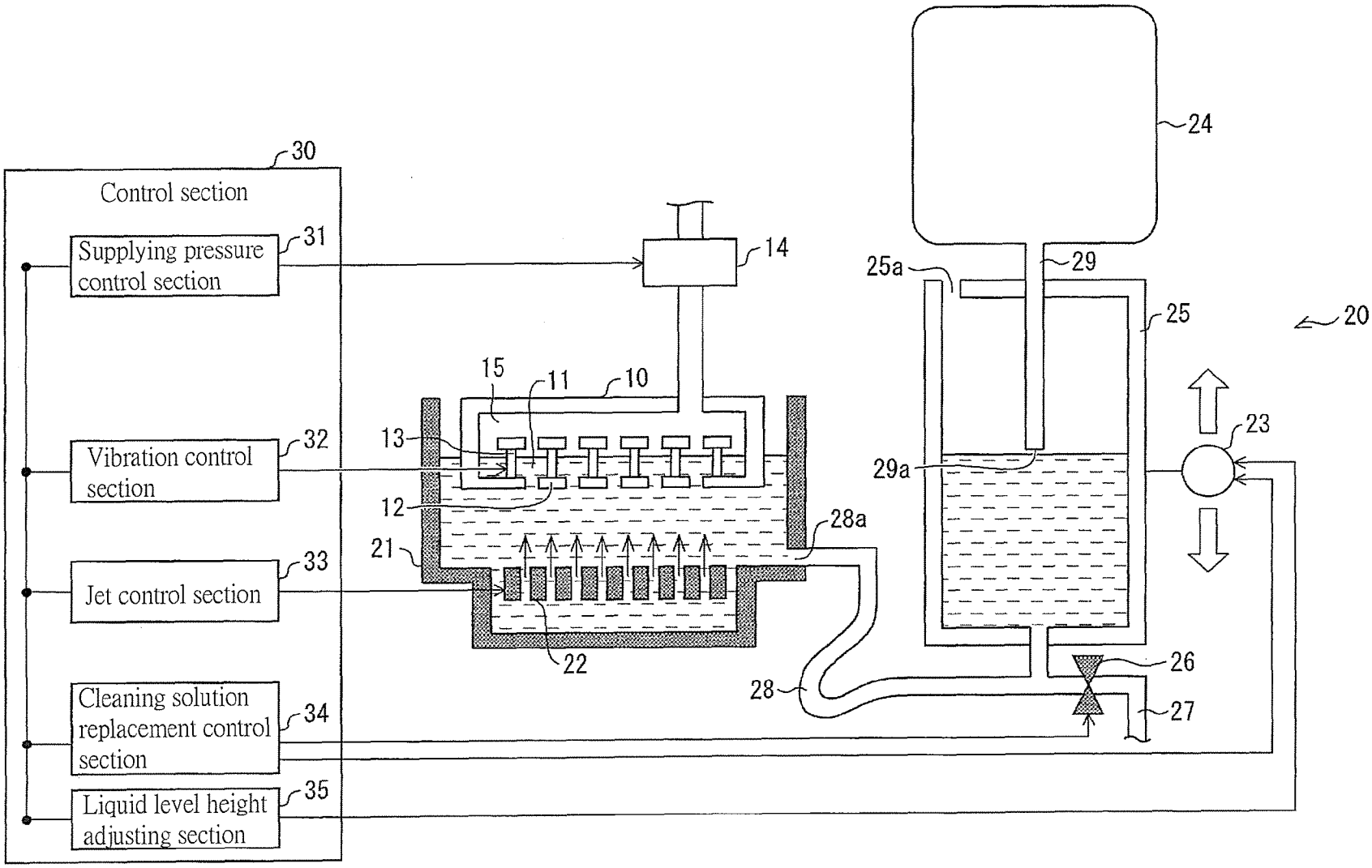
FIG. 1 is a schematic diagram explaining a schematic configuration of a head cleaning device of an embodiment of the present invention.
Figure 4:
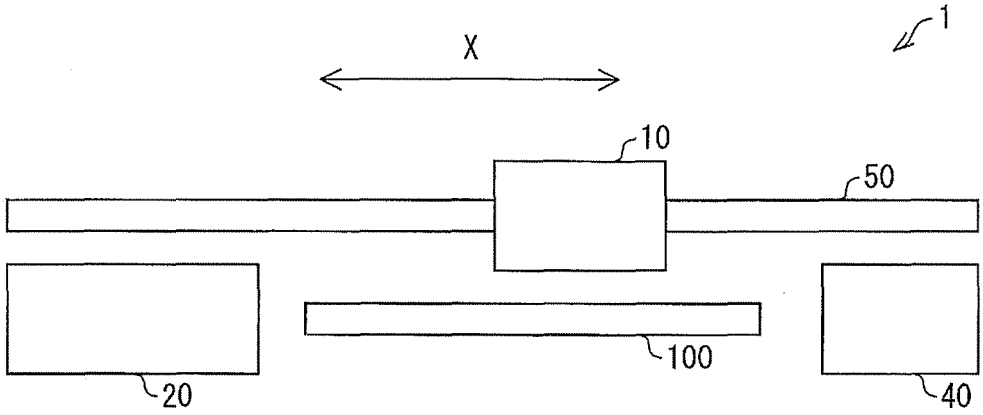
FIG. 4 is a block diagram showing a schematic configuration of an ink jet recording device of the embodiment of the present invention.

Hereinbelow, one embodiment of a cleaning method and a cleaning device according to the present invention will be described in detail with reference to the drawings. FIG. 1 is a diagram showing a configuration of a cleaning device (head cleaning device) 20 that is one embodiment of a head cleaning device according to the present invention. FIG. 4 is a diagram showing a configuration of an ink jet recording device 1 provided with the cleaning device 20.

<Configuration of Head 10>

The cleaning device 20 is for cleaning a head (recording head) 10. Firstly, a configuration of the head 10 will be described. The head 10 includes a pressure chamber 11, nozzles 12, vibration elements 13, and an ink supply chamber 15.

The pressure chamber 11 is inside the head 10 and is communicated with the nozzles 12 for discharging ink.

The nozzles 12 are holes for discharging the ink. The ink is discharged in droplets by a pressure applied to the ink within the pressure chamber 11 being raised and dropped by vibration being applied to the pressure chamber 11 by the vibration elements 13.

The vibration elements 13 are for causing the ink to be discharged from the nozzles 12 by vibrating. In cleaning a surface of the head where the nozzles are provided (hereinbelow referred to as a "nozzle surface" for the convenience of description), flushing is performed by discharging the ink from the nozzles 12 by applying vibration to the pressure chamber 11 by the vibration elements 13. Further, also in the event of discharging the ink onto a medium 100 shown in FIG. 4, the ink is discharged from the nozzles 12 by the vibration of the vibration elements 13.

Further, an ink supply tube is connected to the head 10, and a supplying pressure adjusting section 14 for adjusting a supplying pressure of the ink to be supplied to the head 10 is provided on the supply tube. The supplying pressure by the supplying pressure adjusting section 14 is controlled by a supplying pressure control section 31 to be described later.

The ink supply chamber 15 is for storing ink supplied from outside, and which is to be supplied to the pressure chamber 11. The supplying pressure of the ink relative to the ink supply chamber 15 is adjusted by the supplying pressure adjusting section 14.

However, the configuration of the head 10 is not limited to the above, and a configuration of a known ink jet printer head can be adapted.

<Configuration of Cleaning Device 20>

The cleaning device 20 includes a cleaning tank (cleaning tank) 21, an ultrasonic oscillation device 22, a driving section (driving means) 23, a cleaning solution tank 24, a supply chamber 25, an operating valve (opening and closing means) 26, a discharging passage 27, a first communication passage 28, a second communication passage (communication passage) 29, and a control section 30.

The cleaning tank 21 is a tank for storing cleaning solution for immersing the nozzle surface. In cleaning the nozzle surface, the nozzle surface is immersed in the cleaning solution stored in the cleaning tank 21.

The ultrasonic oscillation device 22 is for jetting the cleaning solution toward the nozzle surface by ultrasound waves. According to this, cleaning effect can further be increased. Notably, it is more preferably to perform the flushing while jetting the cleaning solution by the ultrasound waves. According to this, the ink is discharged from the nozzles, and the cleaning solution can be prevented from unnecessarily entering to an upstream side of the nozzles.

Further, the jetting means provided in the cleaning device according to the present invention is not limited to those generating the jet by the ultrasound waves, but may be configured, for example, of a liquid pumping device and the like, such as a pump.

The driving section 23 is for adjusting relative heights of the cleaning tank 21 and the supply chamber 25 by moving at least any one of the cleaning tank 21 and the supply chamber 25. In the present embodiment, the driving section 23 is driving mechanism that moves the supply chamber 25 and the cleaning solution tank 24 in a vertically up and down direction, and may, for example, include a rail extending in the vertically up and down direction and be configured to move on the rail. However, in the present invention, the driving section 23 simply needs to be configured capable of adjusting the relative heights of the cleaning tank 21 and the supply chamber 25, and no limitation is made to the present embodiment. That is, the driving section 23 may be driving means that moves the cleaning tank 21 in the vertically up and down direction, and a driving direction thereof is not limited to the vertical direction also.

The cleaning solution tank 24 is a container for storing new cleaning solution to be supplied to the cleaning tank 21. The cleaning solution tank 24 is communicated with the supply chamber 25 through the second communication passage 29.

The supply chamber 25 is a tank for storing the cleaning solution to be supplied to the cleaning tank 21. The supply chamber 25 is communicated with the cleaning tank 21 by the first communication passage 28.

The discharging passage 27 branches apart from the first communication passage 28, and has the operating valve 26 provided thereon. The operating valve 26 and the discharging passage 27 are for discharging the cleaning solution from the cleaning tank 21 and/or the supply chamber 25. That is, the cleaning solution within the cleaning tank 21 and/or the supply chamber 25 is discharged by opening the operating valve 26.

The cleaning solution in the cleaning tank 21 can be replaced by discharging at least a part of the cleaning solution by the driving section 23 and the operating valve 26 after the cleaning of the head 10 has been performed for a predetermined number of times, and thereby supplying the new cleaning solution. By using the cleaning solution for plural times, there is a risk that a cleaning effect is reduced by the cleaning solution becoming dirty, however, high cleaning effect can be maintained by replacing the cleaning solution.

The first communication passage 28 is a passage communicating the cleaning tank 21 and the supply chamber 25. The first communication passage 28 has flexibility at least in part thereof, so that the cleaning tank 21 and the supply chamber 25 are efficiently communicated despite changes in the relative heights of the cleaning tank 21 and the supply chamber 25.

The second communication passage 29 is a passage for communicating the supply chamber 25 and the cleaning solution tank 24.

The control section 30 is for controlling respective sections of the head 10 and the cleaning device 20 upon performing cleaning of the head including the nozzle surface.

The control section 30 includes the supplying pressure control section 31, a vibration control section 32, a jet control section 33, a cleaning solution replacement control section 34, and a liquid level height adjusting section (liquid level height adjusting means) 35.

The liquid level height adjusting section 35 controls the driving section 23 to adjust the relative heights of the cleaning tank 21 and the supply chamber 25. Since the cleaning tank 21 and the supply chamber 25 are communicated, the cleaning solution moves between the cleaning tank 21 and the supply chamber 25 in accordance with the relative heights of the cleaning tank 21 and the supply chamber 25. According to this, the liquid level height adjusting section 35 can efficiently adjust the liquid level height of the cleaning solution in the cleaning tank 21.

According to this, the liquid level height adjusting section 35 can supply an appropriate amount of cleaning solution to the cleaning tank 21 without using a pump, a liquid level sensor, and the like. Thus, a low cost and highly reliable head cleaning technique can be provided.

Figure 2:
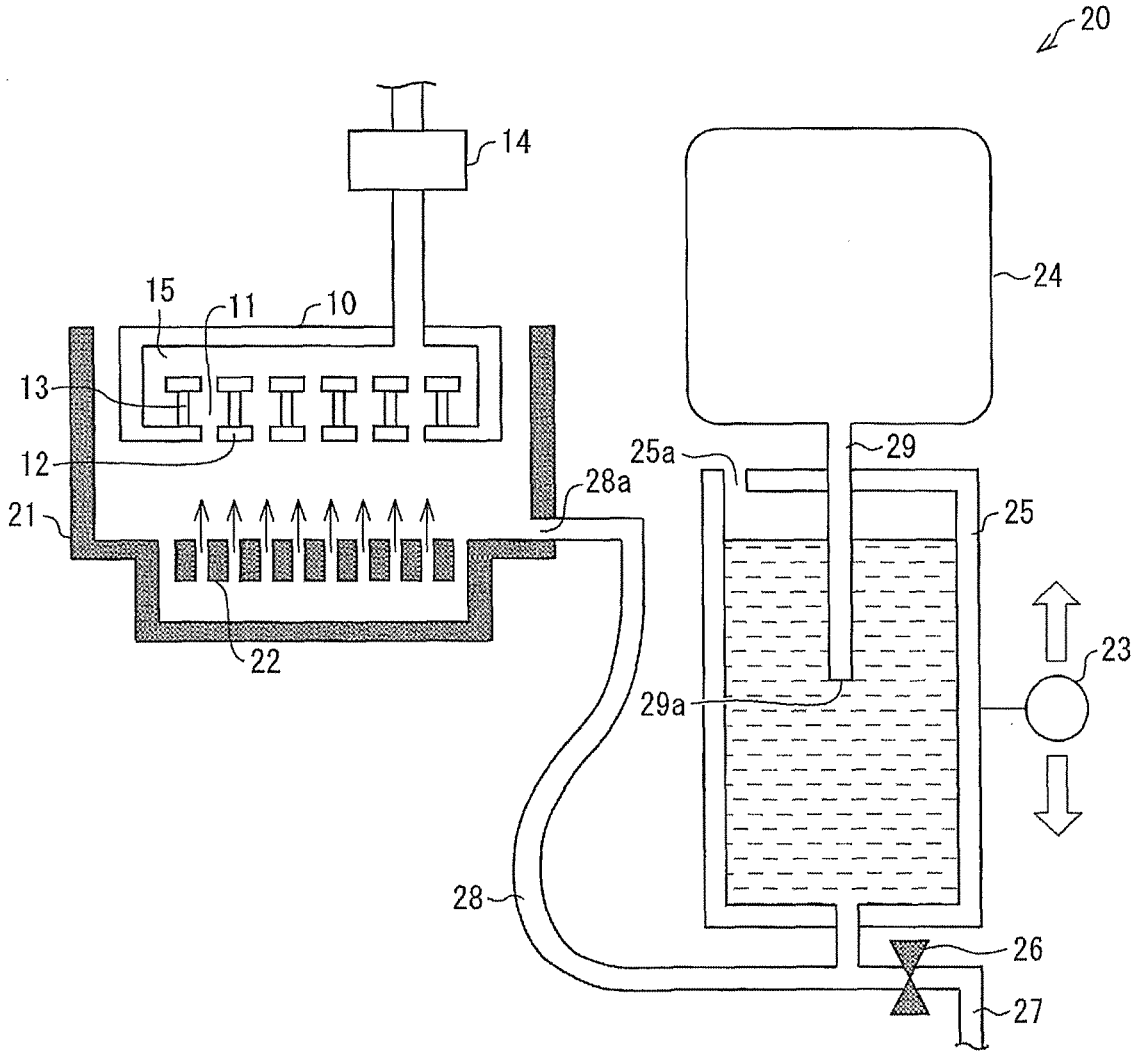
FIG. 2 is a schematic diagram explaining an operation example of the head cleaning device of the embodiment of the present invention.

Further, as shown in FIG. 2, the liquid level height adjusting section 35 can easily discharge the cleaning solution from the cleaning tank 21 by making the height of the supply chamber 25 sufficiently lower than the height of the cleaning tank 21 by the driving section 23. Here, since the cleaning tank 21 has an opening for inputting the head 10, the cleaning solution can volatilize from this opening even during when the head 10 is not being cleaned, however, the volatilization of the cleaning solution can be prevented by discharging the cleaning solution from within the cleaning tank 21.

Notably, in order to more smoothly move the cleaning solution between the cleaning tank 21 and the supply chamber 25, in the present embodiment, the supply chamber 25 includes a ventilation opening 25*a*. According to this, the cleaning solution within the supply chamber 25 moves to the cleaning tank 21, and gas for filling the inside of the supply chamber 25 upon when the liquid level of the cleaning solution in the supply chamber 25 is decreased can smoothly be supplied to the supply chamber 25, whereby the movement of the cleaning solution can be made smooth. Especially, by opening both of the cleaning tank 21 and the supply chamber 25 to atmosphere, the liquid level heights in the cleaning tank 21 and in the supply chamber 25 can surely be matched. According to this, the movement of the cleaning solution can be made smoother.

Notably, since a volatile component in the cleaning solution is heavier than air, if the supply chamber 25 is opened to atmosphere, the inside of the supply chamber 25 is in a state of being filled with saturated vapor of the cleaning solution while the inside of the supply chamber 25 is at an atmospheric pressure. Due to this, the cleaning solution can be prevented from unnecessary volatilization.

Notably, in the cleaning tank 21, if a communication opening 28*a* for communicating with the supply chamber 25 is provided at a position higher than a bottom portion of the cleaning tank 21, the cleaning solution stored at a position lower than the communication opening 28*a* cannot be discharged from the cleaning tank 21 even if the relative heights of the cleaning tank 21 and the supply chamber 25 are adjusted.

With respect to this, in the present embodiment, the cleaning solution can efficiently be evacuated from the cleaning tank 21 to the supply chamber 25 by the communication opening 28*a* of the first communication passage 28 being provided at the bottom portion of the cleaning tank 21. According to this, the volatilization from the cleaning tank 21 upon when the head 10 is not being cleaned can suitably be prevented. Notably, the "communication opening 28*a* being provided at the bottom portion of the cleaning tank 21" means that at least a part of the communication opening 28*a* is provided on a bottom surface of the cleaning tank 21, or on a sidewall immediately above the bottom surface of the cleaning tank 21.

Further, in the present embodiment, the cleaning solution tank 24 is an airtight container, and is configured not to allow gas and liquid to flow through except the second communication passage 29. The cleaning solution tank 24 further has rigidity to a degree by which it does not deform even upon being inverted upside down in a state containing the cleaning solution. Moreover, a communication opening 29*a* of the second communication passage 29 is opened at a position that is higher than the bottom surface of the supply chamber 25.

According to this, (i) when the liquid level of the cleaning solution in the supply chamber 25 becomes lower than the communication opening 29*a*, (ii) the communication opening 29*a* is opened to the air, and (iii) the air flows in from the communication opening 29*a* into the second communication passage 29. Then, (iv) the cleaning solution is supplied from the cleaning solution tank 24 to the supply chamber 25 in return. According to this, (v) the liquid level of the cleaning solution in the supply chamber 25 rises. Then, (vi) when the liquid level of the cleaning solution in the supply chamber 25 becomes higher than the communication opening 29*a*, (vii) the communication opening 29*a* is no longer opened to the air, and the air stops flowing into the communication opening 29*a*. Due to this, (viii) the supply of the cleaning solution into the supply chamber 25 is stopped. According to such a mechanism, the suitable amount of cleaning solution can easily be supplied from the cleaning solution tank 24 into the supply chamber 25.

Notably, in one embodiment, an opening surface of the communication opening 29*a* can be provided obliquely relative to the liquid level (horizontal plane) in the supply chamber 25. By configuring as above, an exchange of the air flowing into the communication opening 29*a* and the liquid flowing out from the communication opening 29*a* is performed smoothly, whereby the liquid level in the supply chamber 25 can be maintained at a desired height (position where the communication opening 29*a* is provided). Further, in the case where the opening surface of the communication opening 29*a* is provided obliquely relative to the liquid level (horizontal plane) in the supply chamber 25, an opening area of the communication opening 29*a* opened to the air changes moderately in accordance with a degree of decrease in the liquid level in the supply chamber 25, whereby an amount of air flowing into the communication opening 29*a* can be changed moderately, and the cleaning solution supply into the supply chamber 25 can be performed moderately.

As above, the cleaning device 20 of one embodiment of the present invention includes the cleaning tank 21 for immersing the head 10 in the cleaning solution and cleaning the head 10; and the liquid level height adjusting means for adjusting the liquid level height of the cleaning solution in the cleaning tank 21, wherein the liquid level height adjusting means includes the supply chamber 25 that stores the cleaning solution to be supplied to the cleaning tank 21, and communicates with the cleaning tank 21, and the driving section 23 for adjusting the relative heights of the cleaning tank 21 and the supply chamber 25 by moving at least any one of the cleaning tank 21 and the supply chamber 25.

The supplying pressure control section 31 is for controlling the supplying pressure of the ink to be supplied to the head 10. Specifically, the supplying pressure of the ink to be supplied to the head 10 is controlled by adjusting the supplying pressure adjusting section 14.

Upon cleaning the nozzle surface, the supplying pressure control section 31 raises the supplying pressure before the nozzle surface is immersed in the cleaning solution, or in an immersed state. An ink internal pressure within the head during printing is maintained to be in a subtly negative pressure compared to an atmospheric pressure. On the other hand, during cleaning, it is preferable for the cleaning solution not to enter to an inner side of the head 10 than the nozzles. Thus, by having raised the supplying pressure of the ink to be supplied to the head 10 by the supplying pressure control section 31, the cleaning solution can be prevented from entering into the nozzles 12. Further, if the supplying pressure is raised before immersing the nozzles 12 in the cleaning solution to a degree by which the ink oozes out from the nozzles 12, they can be immersed in the cleaning solution in a state where the air in the nozzles 12 is discharged by the ink. According to this, the cleaning effect can further be increased, since a state in which the cleaning solution can easily enter into the nozzles 12 can be achieved.

In increasing the supplying pressure before the nozzle surface is immersed in the cleaning solution, the supplying pressure control section 31 controls to raise the supplying pressure after having received an instruction to start cleaning at a different occasion by a user input and the like, and before the nozzle surface is immersed in the cleaning solution. For example, the supplying pressure control section 31 or another control section controls whether or not to immerse the nozzle surface in the cleaning solution, and the supplying pressure control section 31 can control to raise the supplying pressure before the controlling to immerse the nozzle surface.

Further, in increasing the supplying pressure in the state where the nozzle surface is immersed in the cleaning solution, the supplying pressure control section 31 may sense whether or not the nozzle surface is immersed in the cleaning solution, and control whether or not to raise the supplying pressure, and may control to raise the supplying pressure after having received a signal indicating that the nozzle surface has been immersed in the cleaning solution from a mechanism for adjusting height of the head 10, a mechanism for adjusting height of the cleaning tank 21, a control section therefor, and the like. Notably, in the case where the supplying pressure control section 31 senses whether or not the nozzle surface is immersed in the cleaning solution, and controls whether or not to raise the supplying pressure, the sensing of the nozzle surface being immersed in the cleaning solution or not may be performed by a sensor and the like that is separately provided, by detecting a contact of the nozzle surface with the cleaning solution, and the sensing may be performed by receiving information indicating the heights of the head 10 and/or the cleaning tank 21 from the mechanism for adjusting height of the head 10 and/or the mechanism for adjusting height of the cleaning tank 21.

Notably, the supplying pressure control section 31 herein is described as having a purpose of controlling the supplying pressure adjusting section 14 in cleaning the head 10. The supplying pressure adjusting section 14 needs to be driven for supplying the ink to the head 10 upon when the ink is discharged onto the medium 100 shown in FIG. 4 for printing thereon, other than upon the cleaning. The control of the supplying pressure adjusting section 14 upon printing may be performed by the supplying pressure control section 31, and a control section of the supplying pressure adjusting section 14 provided separately in the ink jet recording device 1.

The vibration control section 32 controls the vibration elements 13. In cleaning the nozzle surface, the vibration control section 32 controls the vibration elements 13 so as to apply vibration to the pressure chamber 11 in the state where the nozzle surface is immersed in the cleaning solution. The air staying within the nozzles 12 is pushed out from the nozzles 12 by applying the vibration to the pressure chamber 11 in the state where the nozzles 12 are immersed in the cleaning solution to push out liquid from the pressure chamber 11 through the nozzles 12, whereby the nozzles 12 are filled with the cleaning solution and the ink. Further, since the pressure applied to the ink within the nozzles 12 is fluctuated by the vibration, the cleaning solution reciprocates within the nozzles 12. That is, by performing the flushing, foreign matters and ink that has obtained high viscosity within the nozzles 12 can be discharged. Thus, the cleaning effect of the nozzles 12 is further improved.

As a method for sensing whether or not the nozzle surface is in the state of being immersed in the cleaning solution, the vibration control section 32 may, for example, sense similar to the supplying pressure control section 31, and the sensing may be performed by receiving a signal indicating that the nozzle surface is immersed in the cleaning solution from another control section or the like. Moreover, for example, the flushing is started by starting the vibration of the vibration elements 13 in accordance with a predetermined timing that was inputted in advance, such as just after when the nozzle surface is immersed in the cleaning solution, or at the same time as when the operation of the ultrasonic oscillation device 22 is started.

Notably, the description will be given on the premise that the vibration control section 32 aims to control the vibration elements 13 upon cleaning the head 10. The vibration elements 13 need to vibrate upon discharging the ink onto the medium 100 shown in FIG. 4 to print other than upon the cleaning. The control of the vibration upon the printing may be performed by the vibration control section 32, or by a control section of the vibration elements provided separately in the ink jet recording device 1.

The jet control section 33 controls jetting of the cleaning solution by the ultrasonic oscillation device 22. The jet control section 33 controls the ultrasonic oscillation device 22 so that the cleaning solution is jetted toward the nozzle surface in the state where the nozzle surface is immersed in the cleaning solution. The cleaning effect can further be improved by spraying the cleaning solution toward the nozzle surface. Notably, at this occasion, it is preferable that the flushing together is performed. According to this, the cleaning effect can be improved by the cleaning solution reciprocating in the nozzles 12 by the pressure change in the pressure chamber 11.

As a method for sensing whether or not the nozzle surface is in the state of being immersed in the cleaning solution, the jet control section 33 may, for example, sense similar to the supplying pressure control section 31 or the vibration control section 32, and perform the sensing by receiving a signal indicating that the nozzle surface is immersed in the cleaning solution from another control section or the like. Moreover, for example, the jetting is started by starting the oscillation of the ultrasonic oscillation device 22 in accordance with a predetermined timing that was inputted in advance, such as just after when the nozzle surface is immersed in the cleaning solution, or at the same time as when the flushing is started.

The cleaning solution replacement control section 34 controls the driving section 23 and the operating valve 26. Specifically, the cleaning solution replacement control section 34 controls the driving section 23 and the operating valve 26 such that the operating valve 26 is opened after having performed the cleaning of the head 10 for a predetermined number of times, at least a part of the cleaning solution is discharged through the discharging passage 27, and new cleaning solution is supplied to the cleaning tank 21 and/or the supply chamber 25 by the driving section 23. Notably, it should be noted that, according to the configuration of the present embodiment, new cleaning solution is configured to be supplied automatically by the liquid level of the cleaning solution in the supply chamber 25 becoming lower than the communication opening 29*a*.

The cleaning solution replacement control section 34 performs replacement of the cleaning solution by sensing that the cleaning of the head 10 has been performed for a predetermined number of times. How the number of cleaning is counted by the cleaning solution replacement control section 34 can suitably be set. For example, a cycle from the head 10 having been immersed in the cleaning solution and taken out of the cleaning solution can be counted as one time, a cycle from when the user has inputted the instruction to start cleaning until when the instruction to end the cleaning can be counted as one time, or a cycle from when the user inputted the instruction to start cleaning until all of the predeterminedly set steps are completed can be counted as one time. By using the cleaning solution for plural times, there is a risk that a cleaning effect is reduced by the cleaning solution becoming dirty, however, high cleaning effect can be maintained by replacing the cleaning solution.

The cleaning device 20 may further be provided with a wiper for wiping the nozzle surface. The nozzle surface is wet after the cleaning using the cleaning solution. If it moves above the medium 100 in a state of being wet, the cleaning solution may drip onto the medium 100. If the wiper for wiping the nozzle surface and removing the cleaning solution from the nozzle surface is provided, the cleaning solution can be prevented from contaminating the medium 100.

The cleaning device 20 may further be provided with a circulation pump for circulating the cleaning solution in the cleaning tank 21. The cleaning solution is jetting toward the nozzle surface by the ultrasonic oscillation device 22, so it is preferable to provide the cleaning solution to a lower side of the ultrasonic oscillation device 22. Due to this, the cleaning solution may be configured to circulate by the circulation pump by drawing out the cleaning solution from a portion far apart from the ultrasonic oscillation device 22 and supplying the same to the lower side of the ultrasonic oscillation device 22.

<Modification of Cleaning Device 20>

Figure 3:
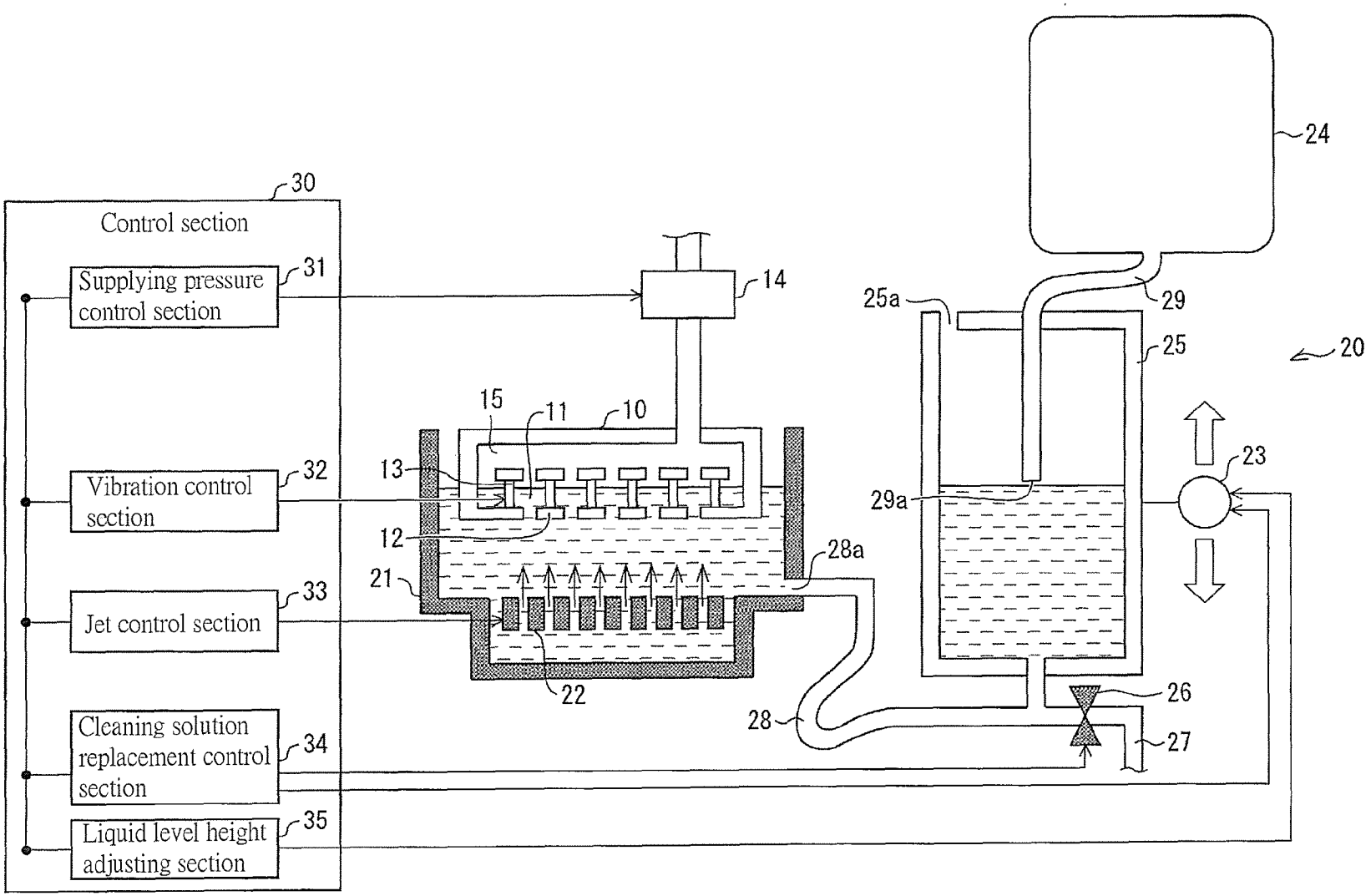
FIG. 3 is a schematic diagram explaining a schematic configuration of a head cleaning device of a modification of the present invention.

Notably, as shown in FIG. 3, the second communication passage 29 may be configured to have flexibility similar to the first communication passage 28, and the driving section 23 may be configured to move only the supply chamber 25 and not to move the cleaning solution tank 24. Due to this, the member to be driven by the driving section 23 can be decreased, and the liquid level height adjustment of the cleaning solution can be performed by less energy.

Notably, it is preferable that the second communication passage 29 is configured not to have any portion that projects upward in a direction of gravity (a portion that becomes locally highest) so that the air having entered from the opening on the supply chamber 25 side of the second communication passage 29 can reach the cleaning solution tank 24 without stagnating in the midst thereof. Specifically, the second communication passage 29 is configured not to have any portion that projects upward in the direction of gravity regardless of the position of the supply chamber 25, by settings of length and width of the second communication passage 29, and a guide member (not shown) for guiding the second communication passage 29. If the second communication passage 29 has the portion that projects upward in the direction of gravity, the air having entered from the opening on the supply chamber 25 side of the second communication passage 29 stagnates, and there is a risk that liquid supply from the cleaning solution tank to the supply chamber may be obstructed, however, by configuring as above, the stagnation of the air can be prevented, and the liquid supply from the cleaning solution tank to the supply chamber can be performed smoothly.

<Configuration of Ink Jet Recording Device 1>

As shown in FIG. 4, the ink jet recording device 1 includes the head 10, the cleaning device 20, a maintenance station 40, and a guiding mechanism 50. The ink jet recording device 1 is for discharging the ink onto the medium 100 to perform printing.

The head 10 scans above the medium 100 by reciprocatingly move along a direction of an arrow X that is a direction defined by the guiding mechanism 50.

The maintenance station 40 is a mechanism for performing maintenance of the head 10, and includes the wiper (wiping means), and a cover (capping means). Specifically, operations such as the flushing, capping, wiping, purging, and the like are performed in the maintenance station 40. For example, these operations are performed upon when a lightly contaminated head 10 is to be cleaned, for which cleaning using the cleaning solution is not necessary.

As aforementioned, the flushing is an operation to clean the nozzles 12 by discharging the highly viscous ink in the nozzles by discharging ink by the vibration of the vibration elements 13. To perform this operation, it is preferable to be provided with a container for receiving the ink from the flushing under the nozzle surface.

The capping refers to covering the nozzle surface of the head 10 when the printing is not taking place so that the ink in the vicinity of the nozzles 12 is not solidified. Accordingly, the maintenance station 40 preferably includes the cover for the head 10. Further, it is preferable to be provided with a suction function that performs suction of the nozzle surface by making inside of the cover have a negative pressure.

The wiping is an operation to wipe the ink (adhered substance) adhered onto the nozzle surface by the wiper. Accordingly, the maintenance station 40 preferably includes the wiper.

The purging is an operation to clean the nozzles 12 by letting ink out of the nozzles 12 by increasing the supplying pressure upon supplying the ink to the head 10, without using the vibration elements 13. The purging is suitably performed, for example, by raising the supplying pressure to the atmospheric pressure or more. Thus, the maintenance station 40 more preferably includes a container for collecting the ink coming out of the nozzles 12 by the purging.

The guiding mechanism 50 is a mechanism for defining the direction along which the head 10 moves. The head 10 is attached to the guiding mechanism 50 so as to be able to move in the direction defined by the guiding mechanism 50 (direction of the arrow X).

The cleaning device 20 is provided below one end of the guiding mechanism 50, and the maintenance station 40 is provided at the other end. The head 10 receives maintenance such as the flushing, wiping, purging and the like by moving above the maintenance station 40 after having performed the printing to some extent. Further, upon when no printing takes place, the head 10 is protected by the capping. Further, when the contamination of the nozzle surface has worsened by having performed greater amount of printing, it is cleaned by moving to above the cleaning device 20.

Accordingly, by providing the cleaning device 20 and the maintenance station 40 respectively on both ends of the guiding mechanism 50, space can be used efficiently. That is, if both of the cleaning device 20 and the maintenance station 40 are provided at one end, a structure of the ink jet recording device 1 on a side of this end becomes too large. Further, the space on the other end is wasteful. By providing the cleaning device 20 using this space that is to be wasteful, the device can further be made compact.

<Operation of Cleaning Device 20>

Next, an operation of the cleaning device 20 will be described.

Firstly, the control section 30 receives a starting instruction of the cleaning. This instruction may, for example, be inputted by the user, or the cleaning may automatically be started after a predetermined amount of printing has taken place.

Next, the control section 30 sends an instruction to move the head 10 to above the cleaning device 20 to the control section that controls the movement of the head 10. According to this, the head 10 moves to above the cleaning device 20. Notably, the moving instruction for the head 10 may be configured to be sent by the control section 30.

Next, the supplying pressure control section 31 determines whether or not to raise the supplying pressure before the nozzle surface is immersed in the cleaning solution. This determination is, for example, based on settings and the like by the user. If the supplying pressure is set to be raised before the nozzle surface is immersed in the cleaning solution, the supplying pressure control section 31 controls the supplying pressure adjusting section 14 and raises the supplying pressure of the ink (supplying pressure raising step). The process proceeds to an immersing step after the supplying pressure has been raised in the case where the supplying pressure is set to be raised before the nozzle surface is immersed in the cleaning solution, and the process proceeds to an immersing step without the supplying pressure control section 31 controlling the supplying pressure adjusting section 14 if the supplying pressure is not set to be raised before the nozzle surface is immersed in the cleaning solution.

In the immersing step, the nozzle surface is immersed in the cleaning solution. Specifically, after having adjusted the liquid level height of the cleaning solution in the cleaning tank 21, the position of the head 10 is lowered to be moved to the cleaning solution in the cleaning tank 21, or the cleaning tank 21 is raised to a position higher than a position where the cleaning solution covers the nozzle surface. Both of the head 10 and the cleaning tank 21 may be moved. Alternatively, the liquid level height of the cleaning solution in the cleaning tank 21 may be adjusted to the position higher than the position where the cleaning solution covers the nozzle surface.

As described above, the adjustment of the liquid level height of the cleaning solution in the cleaning tank 21 is performed by the liquid level height adjusting section 35 controlling the driving section 23 to adjust the height of the supply chamber 25. Notably, the liquid level height adjusting section 35 may be configured to adjust the height of the cleaning tank 21. Further, when the cleaning tank 21 is raised to the position higher than the position where the cleaning solution covers the nozzle surface, the height of the supply chamber is adjusted at the same time to maintain the liquid level height of the cleaning solution.

Whether or not the nozzle surface is immersed in the cleaning solution may be sensed by detecting the nozzle surface making contact with the cleaning solution by using the sensor and the like that is separately provided, as aforementioned, or may be sensed by receiving information indicating the heights of the head 10 and/or the cleaning tank 21 from a mechanism for adjusting the height of the head 10 and/or a mechanism for adjusting the height of the cleaning tank 21, or may be sensed by receiving a signal indicating that the nozzle surface has been immersed in the cleaning solution from another control section and the like.

Next, in the state where the nozzle surface is immersed in the cleaning solution, the ink is discharged from the nozzles 12 by applying vibration to the pressure chamber 11 by the vibration elements 13 to start flushing (vibrating step).

The air remaining in the nozzles is pushed out from the nozzles by the vibrating step, and the nozzles are filled with the cleaning solution and the liquid that had been in the head. Further, by the cleaning solution moving reciprocatingly within the nozzles, foreign matters and ink that has obtained high viscosity within the nozzles can be discharged.

Further, the supplying pressure control section 31 controls the supplying pressure adjusting section 14 to raise the supplying pressure in the state where the nozzle surface is immersed in the cleaning solution (supplying pressure raising step). The supplying pressure raising step that raises the supplying pressure in the state where the nozzle surface is immersed in the cleaning solution may be performed from before the vibrating step is started, the supplying pressure raising step may be started at the same time as the start of the vibrating step, or the supplying pressure raising step may be started after the vibrating step has started. Further, the supplying pressure raising step may be performed after the vibrating step has been completed, however, it is preferable to be performed during the vibrating step, that is, while flushing is performed. The cleaning effect within the nozzles 12 is further improved. Further, the supplying pressure raising step may be performed at any of timings including before and after a jetting step to be described later, and during the jetting step.

Notably, a degree of increase in the supplying pressure by the supplying pressure raising step simply needs to be enough to allow the ink come out from the nozzles 12, and more preferably at a degree that is enough for a small amount of ink to ooze out.

Further, the jet control section 33 controls the ultrasonic oscillation device 22 to cause the cleaning solution to jet toward the nozzle surface in the state where the nozzle surface is immersed in the cleaning solution (jetting step). The jetting step may be performed from before the vibrating step is started, the jetting step may be started at the same time as the start of the vibrating step, or the jetting step may be started after the vibrating step has been started. Further, the jetting step may be performed after the vibrating step has been completed, however, it is preferable to be performed during the vibrating step, that is, while flushing is performed. This is because the cleaning solution can be prevented from excessively entering into the nozzles 12. Further, the jetting step may be performed at any of timings including before and after the supplying pressure raising step, and during the supplying pressure raising step.

Finally, the control section 30 receives a signal indicating completion of the cleaning of the head 10, and causes the supplying pressure control section 31, the vibration control section 32, and the jet control section 33 to complete the supplying pressure raising step, the vibrating step, and the jetting step, respectively. The signal indicating completion of the cleaning of the head 10 can suitably be set. For example, it may be a signal indicating that at least one step among the vibrating step, the supplying pressure raising step, and the jetting step was performed for a predetermined time period, or it may be a signal indicating an instruction to complete the cleaning inputted by the user.

When the cleaning of the head 10 is completed, the liquid level height adjusting section 35 controls the driving section 23 to adjust the height of the supply chamber 25 to be lower than the position during the cleaning, and causes the cleaning solution to be evacuated from the cleaning tank 21 to the supply chamber 25. The volatilization of the cleaning solution can be controlled by evacuating the cleaning solution from the cleaning tank 21 having the large opening for inputting the head 10.

The cleaning solution replacement control section 34 senses a number of times the cleaning was performed after the cleaning solution replacing step was performed previously from the signal indicating the start of the cleaning of the head 10 and the signal indicating the completion thereof. Notably, if the cleaning solution replacing step has never been performed in the past, the number of times the cleaning was performed since the cleaning by the cleaning device 20 was performed for the first time is sensed.

The cleaning solution replacement control section 34 performs the cleaning solution replacing step after the sensed number of times the cleaning was performed has reached a predetermined number of times. That is, the cleaning solution replacement control section 34 controls the operating valve 26 and the driving section 23 such that the operating valve 26 is opened and at least a part of the cleaning solution is discharged through the discharging passage 27 from the cleaning tank 21 and/or the supply chamber 25, and thereafter the height of the supply chamber 25 is adjusted by the driving section 23 to supply new cleaning solution to the cleaning tank 21 and/or the supply chamber 25. The head 10 can be cleaned with high cleaning effect for a long period of time by maintaining the cleaning solution in a fresher state.

The present invention is not limited to the aforementioned embodiments; and various modifications within the scope indicated by the claims can be made, and the embodiments obtained by suitably combining the technical means disclosed in each of the embodiments are also included in the technical scope of the present invention.

<Supplementary Information>

As above, the cleaning device 20 of one embodiment of the present invention includes the cleaning tank 21 for immersing the head 10 in the cleaning solution and cleaning the head 10; and the liquid level height adjusting means for adjusting the liquid level height of the cleaning solution in the cleaning tank 21, wherein the liquid level height adjusting means includes the supply chamber 25 that stores the cleaning solution to be supplied to the cleaning tank 21, and communicates with the cleaning tank 21, and the driving section 23 for adjusting the relative heights of the cleaning tank 21 and the supply chamber 25 by moving at least any one of the cleaning tank 21 and the supply chamber 25.

According to the above configuration, since the cleaning tank 21 and the supply chamber 25 are communicated, the cleaning solution moves between the cleaning tank 21 and the supply chamber 25 depending on the relative heights of the cleaning tank 21 and the supply chamber 25. Due to this, the liquid level height adjusting means can efficiently adjust the liquid level height of the cleaning solution in the cleaning tank 21 by using the driving section 23 that adjusts the relative heights of the cleaning tank 21 and the supply chamber 25.

According to this, the advantageous effect of being able to supply the appropriate amount of cleaning solution into the cleaning tank 21 without using a pump or a liquid level sensor and the like can be achieved. Thus, a low cost and highly reliable head cleaning technique can be provided.

Further, the liquid level height adjusting means can easily discharge the cleaning solution from within the cleaning tank 21 by making the height of the supply chamber 25 sufficiently lower than the height of the cleaning tank 21 by the driving section 23. Here, since the cleaning tank 21 has an opening for inputting the head 10, the cleaning solution can volatilize from this opening also during when the head 10 is not being cleaned, however, according to the above configuration, the advantageous effect that the volatilization of the cleaning solution can be prevented by discharging the cleaning solution from within the cleaning tank 21 can also be achieved.

Further, in the cleaning device 20, the supply chamber 25 includes the ventilation opening 25*a*.

According to the above configuration, since the ventilation opening 25*a* is provided in the supply chamber 25, gas can be supplied into the supply chamber 25 in accordance with the change in the cleaning solution amount in the supply chamber 25. According to this, the movement of the cleaning solution between the cleaning tank 21 and the supply chamber 25 becomes smoother.

Further, in the cleaning device 20, the communication opening 28*a* for communicating with the supply chamber 25 is provided at the bottom portion of the cleaning tank 21.

In the cleaning tank 21, in a case where the communication opening 28*a* for communicating with the supply chamber 25 is provided at a position higher than the bottom portion of the cleaning tank 21, the cleaning solution stored at a position lower than the communication opening 28*a* cannot be discharged from the cleaning tank 21 even if the relative heights of the cleaning tank 21 and the supply chamber 25 are adjusted.

Here, according to the above configuration, since the communication opening 28*a* is provided at the bottom portion of the cleaning tank 21, the cleaning solution can efficiently be evacuated from the cleaning tank 21 to the supply chamber 25. According to this, the volatilization of the cleaning solution from the cleaning tank 21 can suitably be prevented.

Further, the cleaning device 20 includes the discharging passage 27 for discharging the cleaning solution stored in at least any of the cleaning tank 21 and the supply chamber 25, and the operating valve 26 that opens and closes the discharging passage 27.

By using the cleaning solution for plural times, there is the risk that the cleaning effect is reduced by the cleaning solution becoming dirty, however, the high cleaning effect can be maintained by replacing the cleaning solution by discharging the cleaning solution through the discharging passage 27.

Further, the cleaning device 20 includes the airtight cleaning solution tank 24 that stores the cleaning solution, and the second communication passage 29 communicating the cleaning solution tank 24 and the supply chamber 25, and the second communication passage 29 is opened in the supply chamber 25 at a position higher than the bottom surface of the supply chamber 25.

According to the above configuration, since the opening (communication opening 29*a*) of the second communication passage 29 in the supply chamber 25 is positioned at a higher position than the bottom surface thereof, the air moves to the cleaning solution tank 24 through the second communication passage 29 when the liquid level of the cleaning solution in the supply chamber 25 becomes lower than the opening. Then, the cleaning solution is supplied from the airtight cleaning solution tank 24 to the supply chamber 25. According to such a mechanism, the suitable amount of cleaning solution can easily be supplied to the supply chamber 25.

Further, in the cleaning device 20, the cleaning tank 21 and the supply chamber 25 are opened to the atmosphere.

According to the above configuration, due to both of the cleaning tank 21 and the supply chamber 25 being opened to the atmosphere, the liquid level heights of the cleaning solution in the cleaning tank 21 and the supply chamber 25 can surely be matched. According to this, the movement of the cleaning solution between the cleaning tank 21 and the supply chamber 25 becomes smoother.

Further, the ink jet recording device 1 of one embodiment of the present invention includes the cleaning device 20.

According to the above configuration, an ink jet recording device having a low cost and highly reliable head cleaning device can be provided.

The head cleaning method according to one embodiment of the present invention includes: a cleaning step of cleaning the head 10 by immersing the in cleaning solution within the cleaning tank 21; and the liquid level height adjusting step of adjusting the liquid level height of the cleaning solution within the cleaning tank 21, wherein, in the liquid level height adjusting step, the relative heights of the cleaning tank 21 and the supply chamber 25 are adjusted by moving at least any one of the cleaning tank 21 and the supply chamber 25, and the supply chamber 25 stores the cleaning solution to be supplied to the cleaning tank 21 and communicates with the cleaning tank 21.

According to the above method, the advantageous effects of that are the same as those of the cleaning device 20 can be achieved.

INDUSTRIAL APPLICABILITY

The present invention can be used in an ink jet print device.

The invention claimed is:

1. A head cleaning device comprising:

a cleaning tank for immersing a recording head in a cleaning solution and cleaning the recording head;

a liquid level height adjusting apparatus, that adjusts a liquid level height of the cleaning solution in the cleaning tank, wherein the liquid level height adjusting apparatus comprises:

a supply chamber that stores the cleaning solution to be supplied to the cleaning tank, and communicates with the cleaning tank, wherein the cleaning tank and the supply chamber are opened to atmosphere; and a moving driver that adjusts relative heights of the cleaning tank and the supply chamber by moving at least any one of the cleaning tank and the supply chamber such that the liquid level height of the cleaning solution in the cleaning tank and a liquid level height of the cleaning solution in the supply chamber are matched;

a cleaning solution tank for storing the cleaning solution, wherein the airtight cleaning solution tank is located directly above the supply chamber in a variation direction of the liquid level height; and a communication passage for communicating the cleaning solution tank and the supply chamber, wherein the communication passage opens in the supply chamber at a position that is higher than a bottom surface of the supply chamber such that when the liquid level height of the cleaning solution in the supply chamber is at a position lower than an opening of the communication passage in the supply chamber, air moves to the cleaning solution tank through the communication passage to drive the cleaning solution from the cleaning solution tank into the supply chamber.

2. The head cleaning device according to claim 1, wherein the supply chamber comprises a ventilation opening.

3. The head cleaning device according to claim 1, wherein a communication opening for communicating with the supply chamber is provided at a bottom portion of the cleaning tank.

4. The head cleaning device according to claim 1, comprising:

a discharging passage for discharging the cleaning solution stored in at least any one of the cleaning tank and the supply chamber; and an opening and closing means for opening and closing the discharging passage.

5. An ink jet recording device comprising:

the head cleaning device according to claim 1.

6. A head cleaning method comprising:

a cleaning step of cleaning a recording head by immersing the recording head in a cleaning solution within a cleaning tank; and a liquid level height adjusting step of adjusting a liquid level height of the cleaning solution within the cleaning tank, wherein, in the liquid level height adjusting step, relative heights of the cleaning tank and a supply chamber are adjusted by moving at least any one of the cleaning tank and the supply chamber such that the liquid level height of the cleaning solution in the cleaning tank and a liquid level height of the cleaning solution in the supply chamber are matched, wherein a cleaning solution tank for storing the cleaning solution is located directly above the supply chamber in a variation direction of the liquid level height and supplies the cleaning solution to the supply chamber, the supply chamber stores the cleaning solution to be supplied to the cleaning tank, a communication passage is connected to the cleaning solution tank and is inserted into the supply chamber, the cleaning tank and the supply chamber are opened to atmosphere, when the liquid level height of the cleaning solution in the supply chamber is at a position lower than an opening of the communication passage in the supply chamber, air moves to the cleaning solution tank through the communication passage to drive the cleaning solution from the cleaning solution tank into the supply chamber.

7. The head cleaning device according to claim 1, wherein the cleaning solution moves between the cleaning tank and the supply chamber in both directions.

8. The head cleaning device according to claim 7, wherein the cleaning solution flows from the cleaning tank to the supply chamber and flows back from the supply chamber to the cleaning tank.

* * * * *